US006066919A

United States Patent [19]

Bowser et al.

[11] Patent Number: 6,066,919

[45] Date of Patent: May 23, 2000

[54] LIGHTING DEVICE, COMPONENTS THEREFOR AND METHOD OF MANUFACTURE

[76] Inventors: Roger C. Bowser, 3151 E. Des Moines; David P. Wright, 2206 E. Des Moines Cir., both of Mesa, Ariz. 85213

[21] Appl. No.: 08/863,834

[22] Filed: May 27, 1997

[51] Int. Cl.[7] ..... H01J 17/16; H01J 61/30

[52] U.S. Cl. ..... 313/636; 313/634; 313/493; 313/578

[58] Field of Search ..... 313/634, 493, 313/578, 580, 636

[56] References Cited

U.S. PATENT DOCUMENTS

| | | | |
|---|---|---|---|
| 4,401,803 | 8/1983 | Rieder | 528/176 |
| 4,740,583 | 4/1988 | Brunelle et al. | 528/370 |
| 4,764,707 | 8/1988 | Cheng Wei | 313/636 |
| 4,806,618 | 2/1989 | Imai et al. | 528/125 |
| 5,308,894 | 5/1994 | Laughner | 523/436 |
| 5,536,998 | 7/1996 | Sica | 313/493 |

*Primary Examiner*—Ashok Patel
*Attorney, Agent, or Firm*—Stephen T. Sullivan

[57] ABSTRACT

A lighting device is provided which comprises an optically non-opaque wall consisting essentially of a polymeric material and defining a portion of an envelope; a light source sealed within the envelope at a pressure of less than one atmosphere absolute; and an electrical driving device in electrical communication with the light source for causing the light source to generate light. According to another aspect of the invention, a lighting device is provided which comprises an optically non-opaque wall consisting essentially of a polymeric material and defining a portion of an envelope; a gas disposed and sealed within the envelope at a pressure of less than one atmosphere absolute, the wall being substantially impermeable by the gas; and an electrical driving device in at least one of electrical and electromagnetic communication with the gas for activating the gas to generate light. Related methods also are disclosed. In the various devices and methods, the polymeric wall material comprises a polycarbonate material, and may consist of or consist essentially of a polycarbonate material. Electrode housings and connectors also are disclosed.

23 Claims, 11 Drawing Sheets

LIGHTING DEVICE, COMPONENTS THEREFOR AND METHOD OF MANUFACTURE

BACKGROUND OF THE INVENTION

1. Field of the Invention

The present invention relates to lighting devices and, more specifically, to lighting devices, components of such lighting devices, and methods for their manufacture. The apparatus and methods of the invention are particularly well suited for application in gas discharge lighting devices such as neon and fluorescent lighting, and in incandescent lighting.

2. Description of the Related Art

Incandescent lighting devices have been known and used for years. These lighting devices comprise a glass bulb or tube which is sealed to form an envelope. A filament inside the envelope is electrically excited to produce light.

Gas discharge lighting devices have been in commercial use for most of the twentieth century. Examples of gas discharge lighting devices include neon lighting, fluorescent lighting, and the like. Such devices have enjoyed relatively widespread use in applications such as lighting, illuminated signage and decorative works for residential, commercial and industrial uses.

The design and operation of gas discharge lighting devices has been well known for years. See, e.g., Samuel C. Miller, *Neon Techniques & Handling,* Signs of the Times Publishing Co., Cincinnati, Ohio (1977). The devices typically include a sealed envelope comprising a glass tube with metal electrodes at opposing ends. A gas mixture typically including a noble or inert gas, such as neon, and mercury vapor is contained within the envelope and maintained at low pressure. In operation, electrical energy typically in the form of a high-voltage, alternating current is passed through the gas mixture using the electrodes. This electromagnetic energy passing through the gas mixture causes electrons to be liberated from the gas molecules, which accelerates the ionized plasma particles toward the respective electrodes. The plasma particles collide with other gas molecules, which generate additional ions. The net effect is an avalanching of charged particles being generated and recaptured. As the ions are recaptured, energy is emitted from them in the form of light of various wavelengths, including visible and ultraviolet ("UV") wavelengths. In the case of visible light emission, illumination from the device is direct. With UV emission from mercury vapor, visible light is produced by a phosphor coating on the tube interior by fluorescence stimulated by the UV. Traditionally the tubing for such lighting has been formed of various types and grades of glass. Examples of glasses used in neon and fluorescent tubing have included lead glasses and lime or soda glasses.

Glass envelope materials have been disadvantageous, for example, in their brittleness and susceptibility to breakage. Their brittleness also has had the disadvantageous effect of preventing the manufacture of bulbs or tubing which has sharp angles, particularly in their cross sectional geometry. The composition, structure and properties of glass also have limited the ability to bond the glass to other materials while maintaining the pressure ranges and tolerances required for effective gas discharge lighting over the range of operating conditions typically encountered by such devices.

In some instances manufacturers of lighting devices have used coating materials or sheathing to coat or otherwise support the glass envelopes. For example, traditional neon lighting glass envelopes have been provided with an exterior coating of a transparent polymer-based material to resist breakage.

The use of coating materials also has been subject to drawbacks. Although such coating materials in some instances have afforded greater structural strength to the glass bulbs or tubing, this added strength still has usually been inadequate. A sharp impact on the exterior of the envelope, even with the coating, in many cases can crack or break the envelope and compromise the vacuum integrity of the envelope interior. Moreover, the use of such coatings has added significantly to the cost and difficulty of manufacturing the devices.

Traditional methods for coupling lighting devices to a power source cable such as a GTO wire also have been limited. The wire typically would be connected or fastened using a screw or similar fastener. Attaching and detaching the wires using this method has been cumbersome, time consuming and inefficient.

OBJECTS OF THE INVENTION

Accordingly, an object of the present invention is to provide a lighting device which is structurally durable and impact resistant.

Another object of the invention is to provide a lighting device which affords greater safety.

Still another object of the invention is to provide a lighting device which affords greater flexibility for design, shaping, and manufacturability.

Another object of the invention is to provide housings and connectors for lighting devices which are structurally sound yet easily detachable.

Another object of the invention is to provide coatings for lighting devices which decrease the permeability of gases through the lighting device walls to thereby improve lifetime and performance of the lighting devices.

Another object of the invention is to provide a method for making such lighting devices and components.

Additional objects and advantages of the invention will be set forth in the description which follows, and in part will be apparent from the description, or may be learned by practice of the invention. The objects and advantages of the invention may be realized and obtained by means of the instrumentalities and combinations pointed out in the appended claims.

SUMMARY OF THE INVENTION

To achieve the foregoing objects, and in accordance with the purposes of the invention as embodied and broadly described in this document, a lighting device is provided which comprises an optically non-opaque wall consisting essentially of a polymeric material and defining a portion of an envelope; a light source sealed within the envelope at a pressure of less than one atmosphere absolute; and an electrical driving means in electrical communication with the light source for causing the light source to generate light. Lighting devices according to this aspect of the invention preferably would comprise incandescent lighting devices. The polymeric wall material preferably comprises a polycarbonate material, and may consist essentially of a polycarbonate material.

In accordance with another aspect of the invention, a lighting device is provided which comprises an optically non-opaque wall consisting essentially of a polymeric material and defining a portion of an envelope; a gas disposed and sealed within the envelope at a pressure of less than one atmosphere absolute, the wall being substantially impermeable by the gas; and an electrical driving means in at least one of electrical and electromagnetic communication with the gas for activating the gas to generate light. The lighting device according to this aspect of the invention preferably comprises a gas discharge lighting device. The polymeric wall material may comprise a polycarbonate material, and may consist essentially of a polycarbonate material. The wall may comprise a substantially cylindrical tube, but one of the significant advantages of the invention over conventional approaches and designs is the great flexibility it affords for the shape of the wall or tube. The wall, for example, may assume a substantially spherical shape, or it may have a cross sectional shape that is non-circular and non-elliptical. The wall also may have a cross sectional profile that is substantially discontinuous.

The wall comprises a plurality of wall sections and at least one coupler for sealably mating at least two adjacent ones of the wall sections to one another. The coupler may include a slip joint. The lighting device also may include a bonding agent for bonding the at least two adjacent wall sections to the at least one coupler. The wall also may include a colorant dispersed within the polymeric material.

The gas may comprise mercury vapor and at least one noble gas. The pressure within the envelope preferably is at most about 20 torr, and the gas preferably has an operating temperature in the envelope of between about 32° C. and 230° C.

In accordance with another aspect of the invention, a method is provided for making a lighting device. According to one aspect of the method, it comprises providing an optically non-opaque wall or tube consisting essentially of a polymeric material to define a portion of a sealed envelope; disposing and sealing a gas within the envelope at a pressure of less than about one atmosphere absolute; and attaching an electrical driving source in at least one of electrical and electromagnetic communication with the gas for activating the gas to generate light. The polymeric wall or tube material preferably comprises a polycarbonate material, and more preferably consists of or consists essentially of a polycarbonate material. The wall or tube may be made using a number by an extrusion process. Examples would include a molding process, a blow molding process, an injection molding process, a vacuum molding process, and other techniques.

In accordance with another aspect of the invention, an electrode housing or electrode housing assembly is provided for a lighting device. The electrode housing assembly comprises an electrode housing having a wall, the electrode housing having an interior cavity within the electrode housing wall and an exterior electrode housing cavity; an electrode shell disposed within the interior electrode housing cavity; an electrically conductive contact member disposed in the exterior electrode housing cavity and in electrical contact with the electrode shell; a first connector disposed at the electrode housing wall adjacent to the exterior electrode housing cavity; and a second connector disposed at the electrode housing wall adjacent to the interior electrode housing cavity and spaced from the first connector.

In accordance with another aspect, a connector is provided for use in a lighting device to connect a power source such as a GTO wire to a lighting electrode housing. The connector comprises a connector body which includes a wall forming an interior cavity having a first end and a second end, and a slide assembly comprising a pair of slide surfaces, a slide channel, and a slide movably disposed within the slide channel to slidably contact the slide surfaces; a locking jaw assembly comprising a locking jaw for gripping the GTO wire, the locking jaw comprising at least two gripping surfaces resiliently disposed within the interior wall cavity at the first cavity end by a pair of support members, at least one of the gripping surfaces being electrically conductive, and an electrically conductive contact ring electrically coupled to the at least one electrically conductive gripping surface, at least one of the support members being in slidable contact with the slide so that movement of the slide toward the first cavity end causes the support member to move at least one of the gripping surfaces closer to the GTO wire; a cap coupled to the connector body wall at the first cavity end to substantially enclose the first cavity end, the cap including a GTO wire access port for passage of the GTO wire through the cap; and a fastener disposed at the second end of the connector body wall for connecting the connector body to the lighting electrode housing.

In accordance with still another aspect of the invention, a connector is provided for use in a lighting device to connect a power source such as GTO wire to a lighting electrode housing. The connector comprises a connector body includes a wall forming an interior cavity having a first end and a second end, the first cavity end having threads, a GTO wire access port for passage of the GTO wire through the wall, and a first contact surface disposed within the interior wall cavity adjacent to the GTO wire access port; a locking jaw assembly mounted within the interior wall cavity, the locking jaw assembly comprising a locking jaw movably and resiliently disposed over the first contact surface and biased away from the first contact surface so that the GTO wire may be inserted through the GTO wire access port and onto the first contact surface while the locking jaw is forced away from the GTO wire and the first contact surface; a second contact surface disposed substantially adjacent to the second wall cavity; a cap having threads for mating to the connector body threads to detachably couple the cap to the connector body wall at the first cavity end to substantially enclose the first cavity end, the cap having a surface which moves toward and contacts the locking jaw and moves the locking jaw toward the first contact surface as the cap threads are further engaged, so that the further engagement of the cap threads causes the locking jaw to move against and secure the GTO wire on the first contact surface; and a fastener disposed at the second end of the connector body wall for connecting the connector body to the lighting electrode housing.

In accordance with another aspect of the invention, a connector is provided for use in a lighting device to connect a power source such as a GTO wire to a lighting electrode housing. The connector comprises a connector body having first and second ends and including a first aperture for passage of the GTO wire; a push button slidably mounted within the connector body at the first end of the connector body and operatively coupled to a second aperture; a biasing device for biasing the second aperture out of alignment with respect to the first aperture, wherein the second aperture becomes aligned with the first aperture when a force is applied to the push button so that the GTO wire may pass through the first and second aperture, and wherein the biasing devices causes the first and second apertures to contact and grip the GTO wire when the force is removed; and a fastener disposed at the second end of the connector body for connecting the connector body to the lighting electrode housing.

In accordance with another aspect of the invention, a coating is provided for a wall of a lighting device. The coating comprises a silicon-bearing material, which may comprise a silica. The wall to which the coating is adapted to be applied preferably includes a polymeric material.

In accordance with yet another aspect of the invention, a lighting device is provided which comprises an optically non-opaque wall consisting essentially of a polymeric material and defining a portion of an envelope; a coating comprising a silicon-bearing material disposed on the wall; a gas disposed and sealed within the envelope at a pressure of less than one atmosphere absolute, the wall being substantially impermeable by the gas; and an electrical driving means in at least one of electrical and electromagnetic communication with the gas for activating the gas to generate light. The wall may include an interior surface and an exterior surface, and the coating may be disposed upon the interior wall surface. The coating may and preferably does comprise silica.

In still another aspect of the invention, a method is provided for deposition a coating on a wall of a lighting device wherein the wall comprises an envelope. The method comprises causing the pressure within the envelope to be substantially at a vacuum; desorbing unwanted gases from the wall; disposing a deposition gas comprising a silicon-bearing material into the envelope; and applying electromagnetic energy across the envelope to cause a portion of the deposition gas to deposit on the wall as a silica coating. The silicon-bearing material comprises a silica, and may comprise a siloxane. The wall according to this aspect of the invention preferably comprises a polymeric material, which preferably comprises a polycarbonate material, and more preferably consists of or consists essentially of a polycarbonate material.

Lighting devices according to the invention may be constructed in sizes significantly larger than have been possible in many prior applications owing to the fact that the wall or envelope material is considerably stronger and more durable than prior envelope materials. For example, 8-foot fluorescent glass tubes are very fragile, but 8-foot polycarbonate tubes are extremely strong and allow for safe handling and controlled recycling.

The polymeric wall preferably comprises the primary wall or tube of the envelope which contains gases and/or maintains the sub-ambient pressure inside the envelope. Although it is possible to use glass or other silica-based materials with the polymeric wall, the polymeric wall preferably provides the primary structural envelope component, and is not merely a sheath or covering for a glass wall or tube. Silica-based coatings may be used, however, in conjunction with the invention, as described more fully below.

BRIEF DESCRIPTION OF THE DRAWINGS

The accompanying drawings, which are incorporated in and constitute a part of the specification, illustrate a presently preferred embodiments and methods of the invention and, together with the general description given above and the detailed description of the preferred embodiments and methods given below, serve to explain the principles of the invention.

FIG. 4, which includes FIG. 4A shows an expanded view of a mated pair of wall sections useful in constructing the wall of the lighting device shown in FIG. 1. FIG. 4B shows an expanded view of a pair of wall sections which are mated using a dual inner connector. FIG. 4C shows an expanded view of a pair of wall sections which are mated using a dual outer connector.

DETAILED DESCRIPTION OF THE PREFERRED EMBODIMENTS AND METHODS

Reference will now be made in detail to the presently preferred embodiments and methods of the invention as illustrated in the accompanying drawings.

In accordance with one aspect of the invention, which preferably comprises a gas discharge lighting device, a lighting device is provided which includes an optically non-opaque wall defining a portion of an envelope, a gas disposed and sealed within the envelope, and an electrical driving means for activating the gas to generate light. The wall consists essentially of a polymeric material. This wall may comprise, and preferably consists of or consists essentially of, a polycarbonate material. The gas within the envelope, which may comprise a mixture of mercury vapor and at least one noble gas, is at a pressure of less than one atmosphere absolute. The wall is substantially impermeable by the gas. The electrical driving means is in at least one of electrical and electromagnetic communication with the gas for activating the gas to generate light.

Figure 1:
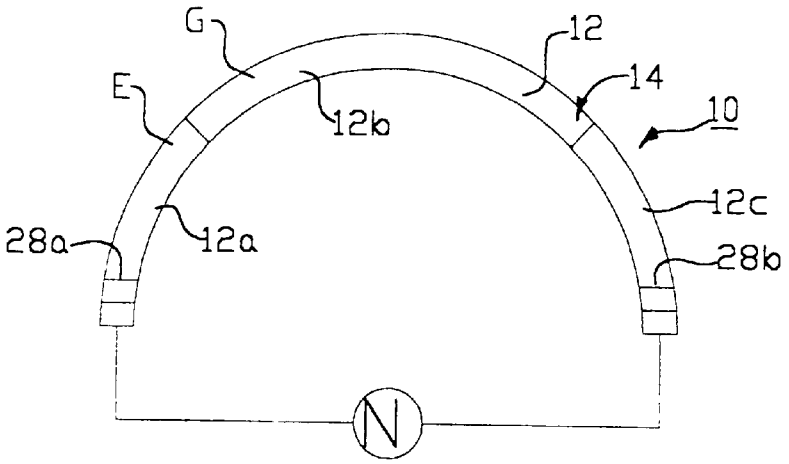
FIGS. 1 and 45 show a gas discharge lighting device according to a preferred embodiment of the invention.

A presently preferred embodiment of a lighting device 10 according to the invention is shown in FIG. 1. Lighting device 10 includes an optically non-opaque wall 12 which forms a substantially cylindrical luminescent tube 14 consisting essentially of a polymeric material. In this instance, the polymeric material comprises a polycarbonate material. Examples of polycarbonate materials suitable for use according to this aspect of the invention are disclosed in U.S. Pat. Nos. 4,806,618, 5,308,894, 4,401,803, and 4,740,583. More specifically, polycarbonate wall 12 and tube 14 preferably comprise a copolymer or copolycarbonate of bis-hydroxyphenylfluorene and bis-phenol-a.

Wall 12 and tube 14 of course have an inside surface 16 and an outside surface 18. The thickness of wall 12 will depend on a variety of factors, including for example the type of wall material, the specific application, and the intended operating environment. Even within a given lighting device, the wall thickness may and usually will vary depending upon the location within the device. For example, one would expect the wall thickness at locations away from bends and corners to differ from the thicknesses at such bends and corners. In the preferred embodiment, as an example, wall 12 has a thickness at locations away from bends and corners of about 0.125 inches. Thicknesses as low as 0.625 also may be used successfully.

Figure 2:
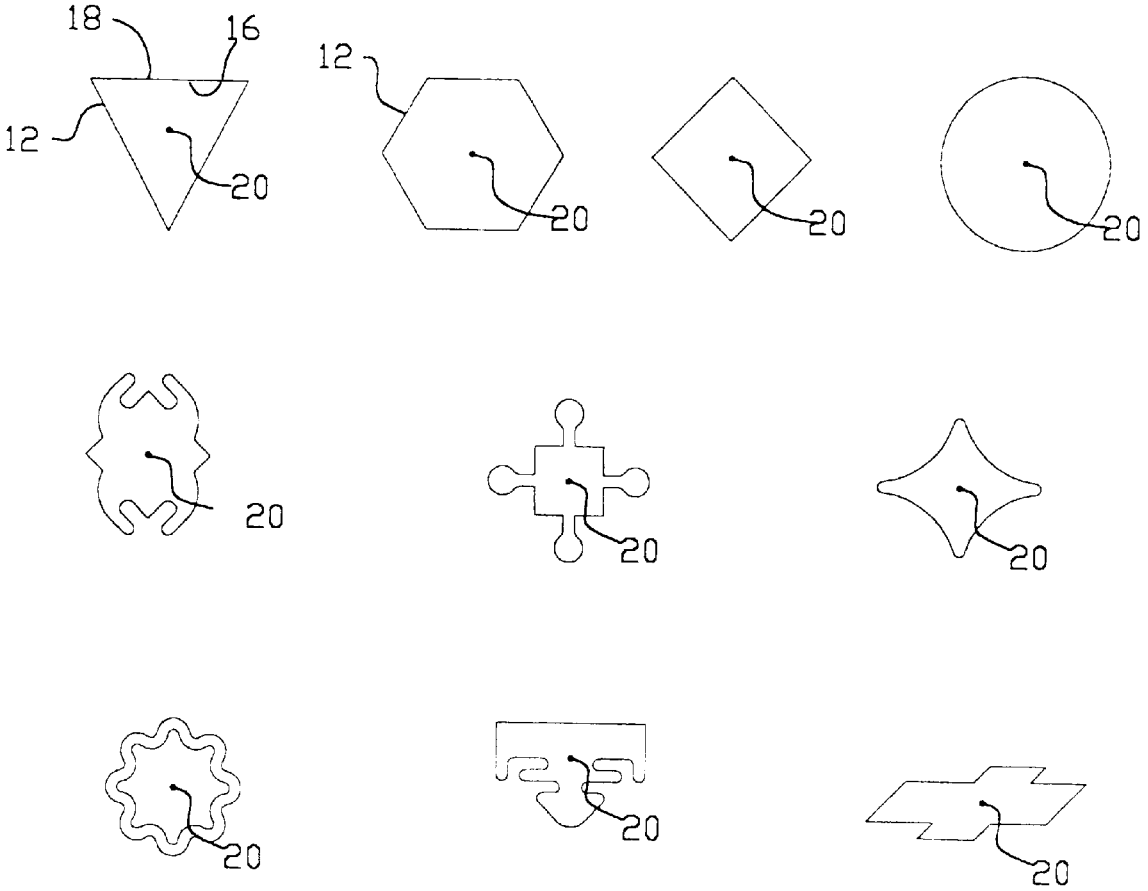
FIG. 2 shows a variety of illustrative cross sectional shapes possible for the wall of lighting devices according to the invention, such as the lighting device shown in FIG. 1.

Wall 12 is in the shape of a substantially cylindrical tube, which of course is probably the most common cross sectional geometry for gas discharge lighting devices. This is not, however, limiting with regard to the invention. The invention provides the ability to achieve essentially any of the shapes previously or currently obtainable using glass-envelope gas discharge lighting devices, such as fluorescent lights and neon lighting. The use of a polymeric wall provides substantial flexibility and other advantages over many prior art devices, however, in that many other shapes and cross sections are possible. With the present invention, for example, the wall may take nearly any shape that can be created using the flowable and/or moldable polymeric wall materials involved. Examples of shapes or profiles possible with the invention include substantially spherical shapes with circular profiles, non-circular shapes, non-elliptical shapes, and many others. The profiles may be circular, elliptical, square, triangular, rectangular, polygonal, concave, convex, etc., and combinations of these. They may include angles, points and corners when viewed with the naked eye. The cross sectional profile of the wall may be substantially discontinuous, in a mathematical sense. Examples of applications for such novel wall and envelope shapes are far reaching, and may include planar and non-planar windows, doorknobs, and a myriad of other objects and shapes. FIG. 2, for example, shows a number of profile extrusion replacement bulb or tube geometries achievable using the principles of the invention which use discontinuous profiles, the term "discontinuous" again being used in a mathematical sense to mean that the profile does not have a smooth surface or surface transition at all points, and includes angles or discontinuities when viewed with the naked eye. Each of these bulbs or tubes is shown in cross section taken substantially orthogonally with respect to a longitudinal axis 20 of the bulb or tube.

Figure 3:
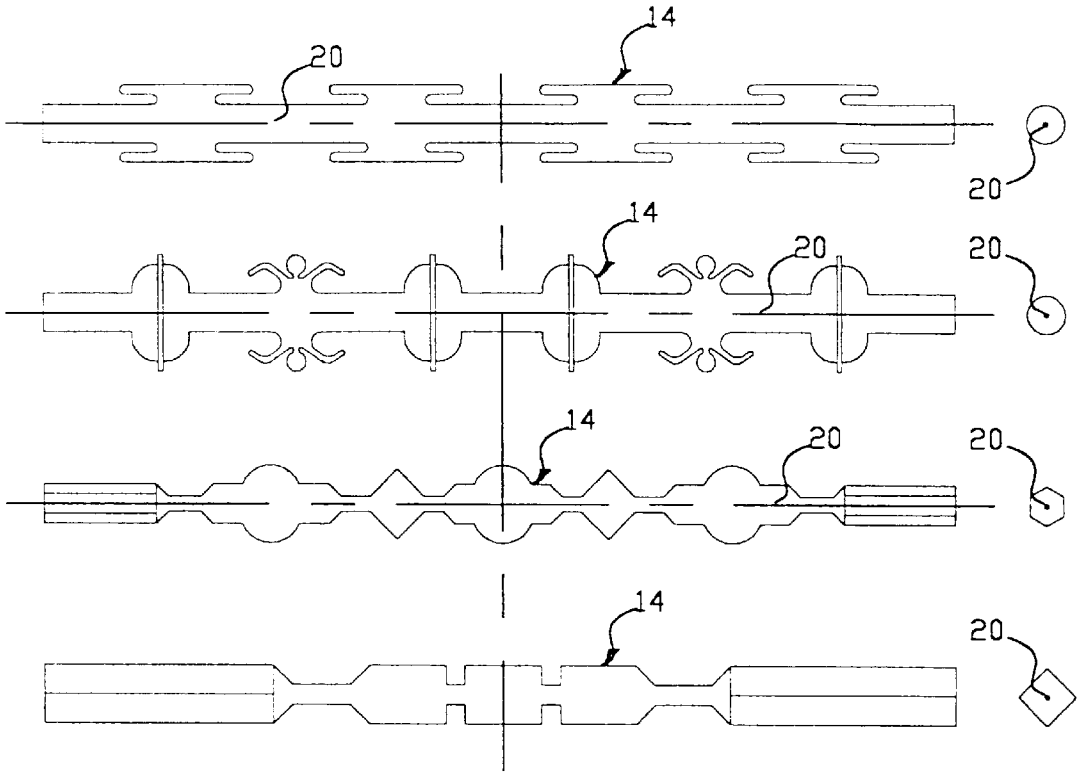
FIG. 3 shows a variety of illustrative side profiles or lengthwise cross sectional shapes possible for the wall of lighting devices according to the invention, such as the lighting device shown in FIG. 1.

With the advantages afforded by the invention, it is also possible to provide non-uniform wall geometries along the length of the wall, substantially parallel to the longitudinal axis of the tubing or envelope. Illustrative examples are shown in FIG. 3. These specialty tubes or fixture bulbs can be fabricated, e.g., using profile extrusion, injection molding techniques, blow molding, and vacuum molding to make a wide variety of configurations. Other fabrication techniques also may be used.

It is also possible using the principles of the invention to include texturing of the exterior wall surfaces. This texturing may be obtained as an integral part of the fabrication process.

Polycarbonate wall 12 and tube 14 define a portion of an envelope E, as will be described more fully below. This envelope forms an air-tight cavity in which the gas (described more fully below) is contained, and where the gas is maintained at the preferred operating pressure, which typically is well below one atmosphere.

Figure 4A:
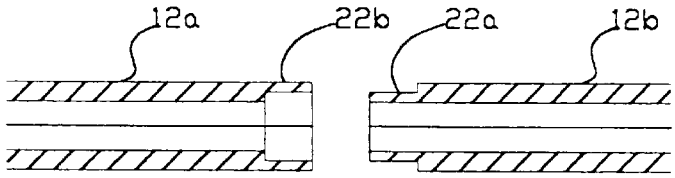
FIGS. 4A through FIG. 4C, shows various wall section and wall section-coupler combinations according to the preferred embodiment of the invention. More specifically.
Figure 4B:
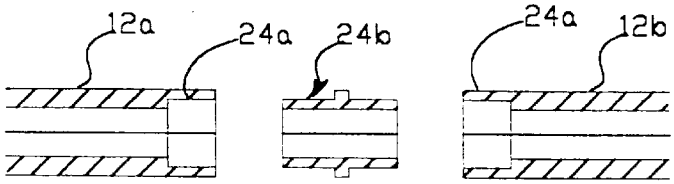
Figure 4C:
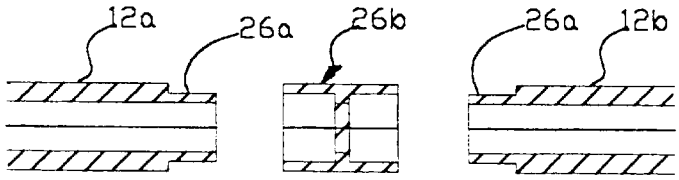

Wall 12 of lighting device 10 may comprise a single piece of polymeric tubing. Alternatively, for example, and in many instances preferably, wall 12 may comprise a plurality of wall sections 12*a*, 12*b*, 12*c*, . . . which mate to one another to form the equivalent of a single tube or chamber. With reference to FIG. 4 (including FIGS. 4A through 4C), for example, wall sections 12*a*, 12*b*, 12*c*, . . . may be provided at their ends with respective inner and outer slip joint connectors 22*a* and 22*b*, respectively, as shown in FIG. 4A so that, when the ends of two adjacent wall sections are joined, they connect to one another through the inner-outer slip joint connection 22.

In accordance with another design, the wall may comprise a plurality of wall sections and at least one coupler for sealably mating at least two adjacent ones of the wall sections to one another. As illustrated in FIG. 4B, for example, the ends of wall sections 12*a*, 12*b*, 12*c*, . . . may be adapted with outer ends 24*a*, and a dual inner connector or coupler 24*b* may be used to join the adjacent wall sections. Similarly, as illustrated in FIG. 4C, the ends of wall sections 12*a*, 12*b*, 12*c*, . . . may be adapted with inner ends 26*a*, and a dual outer connector or coupler 26*b* may be used to join the adjacent wall sections.

The mating means may comprise any of a variety of joining techniques. Slip joints work well in many applications for the coupler or couplers and for the wall sections themselves. They also may and preferably do include locking embossment and recess couplers, such as those shown in the drawings and described below.

The sections and couplers may be bonded to one another using a variety of techniques known in the field, including using a suitable bonding agent. According to another aspect of the invention, a bonding agent may be provided for bonding at least two adjacent wall sections to each other, and/or for bonding at least two adjacent wall sections to at least one coupler. Where two wall sections, or a wall section and a coupler, are to be joined, the resulting joint should be tightly sealed to avoid unwanted leakage of gases. Bonding agents are well suited to this task. The specific bonding agent preferred in a given instance will depend upon a number of factors, such as the particular application, the envelope design including materials, the intended operating environment and operating parameters of the device, etc. General characteristics which should be considered in selecting an appropriate bonding agent for a particular application typically would include its bond strength, curing properties, cured properties, its ability to maintain a vacuum or "vacuum integrity," its permeability or diffusivity for the gases contained within the envelope and for ambient gases which may diffuse into the envelope, its aging characteristics and lifetime, its reaction to thermocycling, its tolerance to humidity ranges, and its suitability in other environmental and operating conditions. The chemical composition of the bonding agent, and its stability and reactivity under operating environments, also are important considerations. The bonding agent according to the preferred embodiment comprises 1-LT high-temperature UV ADH 369, Item No. 36990 (anaerobic UV), commercially available from Locite Corp., Rocky Hill, Conn.

One of the advantageous features of the invention is its flexibility in affording design freedom and artistic expression into the lighting device. For example, the luminous wall portion or tube of the lighting device may assume a wide variety of shapes and sizes, as explained above. Another significant advantage of the present invention lies in the options and flexibility of adding colorants, decorants and other additives to the wall material itself. It is possible in some applications of the invention to disperse colorants or pigmentation within the polymeric material without added brittleness and working difficulties, as often occur in colored glass. This aspect of the invention also can provide a substantial cost advantage over colored glass.

A gas G is disposed and sealed within envelope E of lighting device 10 to generate light during operation of the device. Gas G preferably comprises at least one inert or noble gas, such as neon. The preferred gas composition also may include additives, such as mercury vapor. These features of the gas, however, are illustrative and not limiting. Other gases may be present in additional to those expressly mentioned here. In addition, a variety of alternative gas compositions may be used within the scope of the invention.

Gas G is at a pressure of less than one atmosphere absolute, and for most lighting applications preferably is at most about 20 torr. In this preferred embodiment, the pressure of gas G within envelope E when the device is cold is about 10 millimeters of mercury, and the steady-state operating pressure of the hot gas is about 90° F. to 130° F. The steady-state operating temperature of gas G within envelope E of lighting device 10 preferably is about 98° F. (37° C.). The gas may have an operating temperature within the envelope of between about 32° C. and 230° C.

Lighting device 10 according to the preferred embodiment further includes an electrical driving means which comprises metallic or conductively-coated electrodes 28*a* and 28*b* disposed at opposite ends of wall 12 and tube 14. Tube 14 forms an airtight bond with each of electrodes 28*a* and 28*b*, so that interior surface 16 of wall 12 and the portions of electrodes 28*a* and 28*b* within the area enclosed by wall 12 and tube 14 form and define envelope E. This is not necessarily limiting, however, in that it is possible to design gas discharge lighting devices in which the tube itself is completely sealed and the electrodes are external to the tube.

The electrical driving means is in at least one of electrical and electromagnetic communication with the gas for activating the gas to generate light. In this embodiment, we used a known, industrial standard 60-cycle, high-voltage transformer. This also is not limiting. Most commercially-known, high-voltage power supplies for gas discharge lighting devices operating within standard or known ranges for such commercial power supplies would be suitable. Embodiments according to the invention also could be operated, for example, using d.c. power.

It will be appreciated by those of ordinary skill in the art that the detailed design particulars of the electrical driving means may vary depending on a number of factors. Examples of such factors would include the particulars of the gas, such as its composition, pressure, and temperature; and the particulars of wall 12 and envelope E, such as the wall composition, its geometry, volume or dimensions, coatings; etc. The design of the electrical driving means also may be influenced by largely electrical considerations, such as the desired form of signal which is to be passed through the gas composition, the frequency if AC, intensity, modulation, etc. As in other forms of gas discharge lighting devices, d.c. and a.c. signals having a wide variety of characteristics and waveforms may be employed.

Figure 5:
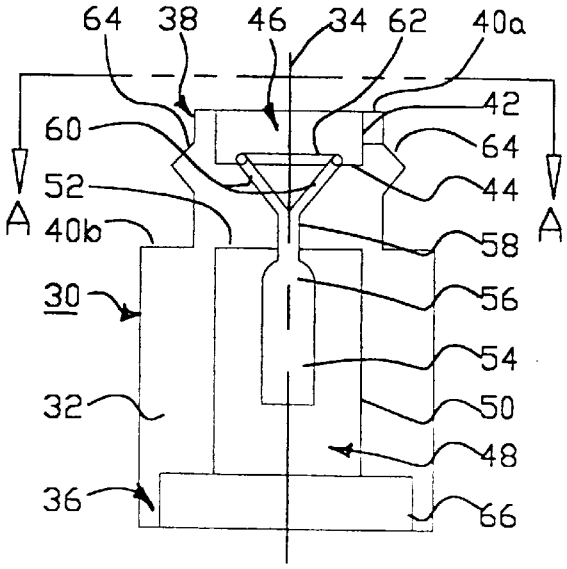
FIG. 5 shows a side cutaway view of an electrode housing used in the lighting device of FIG. 1.
Figure 6:
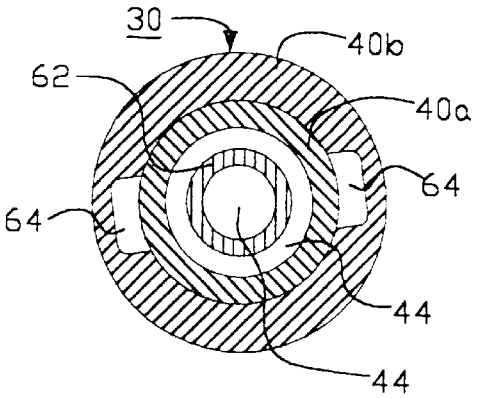
FIG. 6 shows a top view of the electrode housing shown in FIG. 5, viewed from the position and in the direction depicted by arrows A—A in FIG. 5.

Further in accordance with the invention, an electrode housing assembly is provided for lighting devices such as the one shown in FIG. 1. An electrode housing assembly 30 according to the preferred embodiment of the invention is illustrated in FIGS. 5 and 6. FIG. 5 is a side cutaway view of electrode housing assembly 30. FIG. 6 provides a top view of assembly 30, viewed in the direction indicated by the arrows A—A in FIG. 5. The principal function of electrode housing assembly 30 is to secure the electrical power source, usually in the form of a GTO wire (GTO) to the luminous tube body 14, which in this embodiment is formed by polycarbonate wall 12. Electrode housing 30 may comprise either or both of electrodes 28*a* and 28*b* as shown in FIG. 1.

The electrode housing assembly according to the invention comprises an electrode housing having a wall, wherein the electrode housing has an interior cavity within the electrode housing wall and an exterior electrode housing cavity.

As implemented in the preferred embodiment, electrode housing assembly 30 comprises a substantially cylindrical electrode housing 32 disposed about a longitudinal axis 34. Electrode housing 32 includes a proximal end 36 which in use is directed toward luminous tube body 14, and a distal end 38 which in use is directed away from luminous tube body 14. Incidentally, alternative variations on this basic theme may be used in accordance with the invention. For example, two electrode housings 32 (one at each end of the tube) and luminous tube 14 connected to them may be contained in a secondary body, e.g., such as in a transparent or translucent spherical globe.

Distal end 38 of electrode housing 32 includes a first abutting surface 40*a*, a second abutting surface 40*b*, a wall 42 extending from abutting surface 40*a* along longitudinally axis 34, and a surface 44 extending from wall 42. Abutting surface 40*a* and surface 44 are perpendicular to longitudinal axis 34, whereas wall 42 is parallel to longitudinal axis 34. Wall 42 and surface 44 form an exterior cavity 46 in distal end 38 of electrode housing 32.

Electrode housing 32 also includes an interior cavity 48 which is formed by a substantially cylindrical wall 50 disposed about longitudinal axis 34 and a surface 52 adjoining wall 50. Interior cavity 48 opens toward proximal end 36 of electrode housing 32.

The electrode housing assembly according to the invention also includes an electrode shell disposed within the interior electrode housing cavity. In the preferred embodiment, an electrode shell 54 is disposed within interior cavity 48. Electrode shell 54 comprises an electrically-conductive shell of known design, such as commercially-available electrode shells comprising barium. It is substantially cylindrical in its body section about longitudinal axis 34, and includes a substantially hemispherical cap portion 56. A stem 58 extends from cap 56 and enters surface 52. A set of posts 60 extend from stem 58.

The electrode housing assembly further includes an electrically-conductive contact member disposed in the exterior electrode housing cavity and in electrical contact with the electrode shell. In the preferred embodiment, an electrically-conductive contact member in the form of a contact ring 62 is disposed in exterior electrode housing cavity 46. Contact ring 62 is electrically coupled to posts 60, which places it in electrical contact with electrode shell 54. It should be noted that stem 58 and posts 60 extend through wall 52 and surface 44 of electrode housing 32 in an air-tight fashion so that, under the operating pressures involved, gases may not escape through this area. This sealing may be accomplished using any one of a number of known techniques, such as molding stem 58 and posts 60 into the electrode housing material, or by suitably bonding stem 58 and posts 60 into apertures created for them using an appropriate bonding and sealing agent.

The electrode housing also includes a first connector disposed at the distal end of the electrode housing and adjacent to the exterior electrode housing cavity. According to the preferred embodiment, the first connector comprises a lock tab or embossment 64 at distal end 38 of electrode housing 32 and adjacent to exterior cavity 46. Lock tab 64 is used to mechanically couple electrode housing 30 to an end cap (described below) in a bayonet-type locking arrangement, which has the resultant effect of electrically coupling the GTO wire to electrode shell 54.

The electrode housing assembly further includes a second connector disposed at the proximal end of electrode housing adjacent to the interior electrode housing cavity and spaced from the first connector. In the preferred embodiment, the second connector comprises an outer socket 66 at proximal end 36 of electrode housing 32 for slip-joint attachment to polycarbonate tube 14. Outer socket 66 is bonded to polycarbonate tube 14 using a suitable bonding agent as described above.

For successful operation of the lighting device, it is necessary to couple the power source, typically a GTO wire, to the electrode housing assembly. In accordance with another aspect of the invention, a connector is provided for use in a lighting device to connect an electrode power source to a lighting electrode housing. A preferred connector 68 according to this aspect of the invention is illustrated in FIGS. 7 through 16. This connector comprises a locking end cap assembly.

Figure 7:
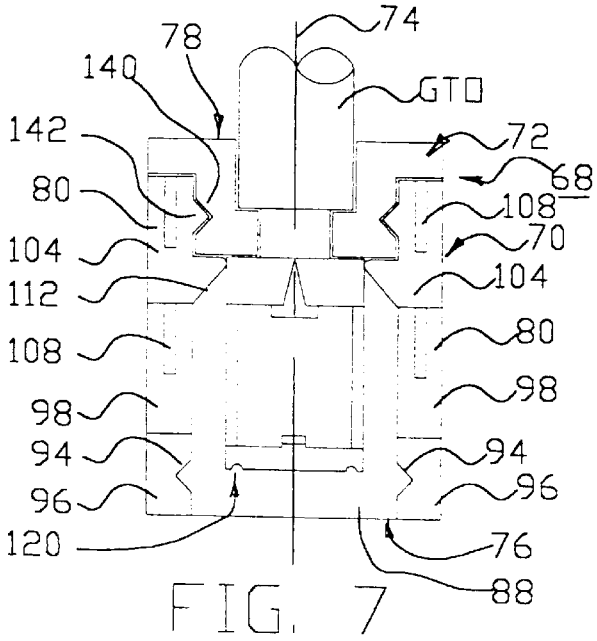
FIG. 7 shows a side cutaway view of a sliding locking end cap connector assembly according to a preferred embodiment of the invention for use in connecting a GTO wire to the electrode housing shown in FIG. 5.

With reference to the preferred embodiment as generally shown in FIG. 7, locking end cap assembly includes a connector body 70 and a sliding locking end cap top 72. Connector body 70 is a substantially cylindrical body disposed about a longitudinal axis 74 and having a proximal end 76 and a distal end 78. Connector body 70 includes a wall 80 with an interior surface 82 and an exterior surface 84. Wall 80, and more particularly its interior surface 82, forms an interior cavity 86, which correspondingly has a proximal end 88 and a distal end 90.

Connector body 70 at its distal end 78 includes a receiving aperture 92 which in turn includes a locking recess 94. Locking recess 94 is adapted to receive electrode housing embossment 64 (FIG. 5) in a bayonet-type locking arrangement as described above. When engaged, locking recess 94 and electrode housing embossment 64 form a moisture-resistant seal under the operating conditions of lighting device 10. This moisture-resistant seal is achieved by proper mating of the embossment and recess, and generally does not require a bonding agent.

Figure 8:
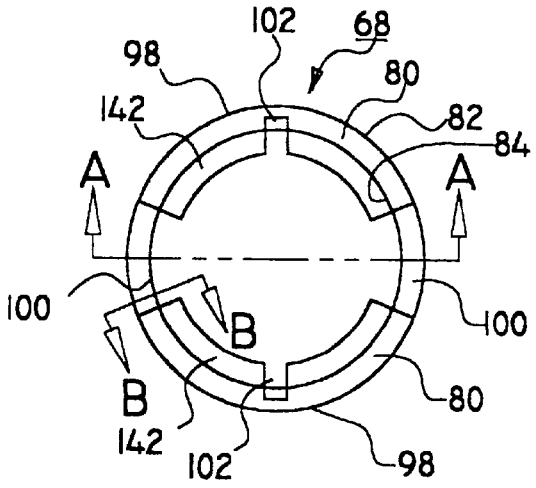
FIG. 8 shows a top view of the sliding locking end cap body shown in FIG. 7.
Figure 9:
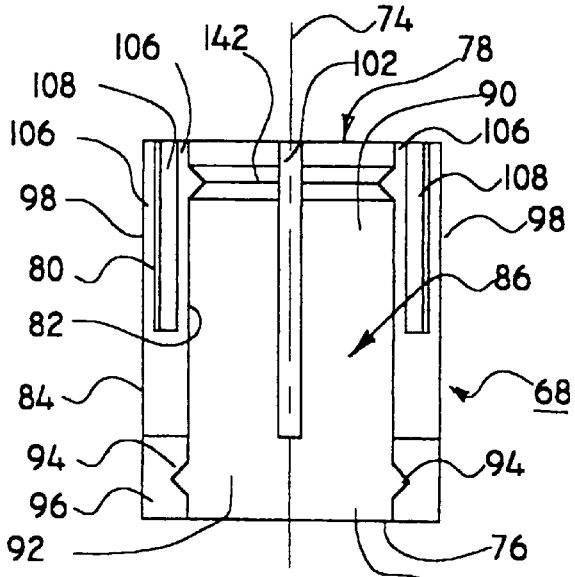
FIG. 9 shows a side cutaway view of the sliding locking end cap top shown in FIG. 7, viewed from the position and in the direction depicted by arrows A—A in FIG. 8. This view shows the body without the slide.
Figure 10:
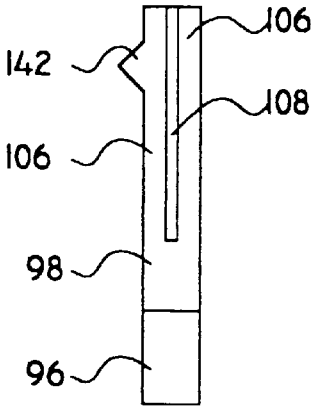
FIG. 10 shows a side cutaway view of slide assembly guide of the sliding locking end cap body shown in FIG. 7, viewed from the position and in the direction depicted by arrows B—B in FIG. 8. This view shows the slide assembly guide without the slide.

A top view of connector body 70 without other components of sliding locking end cap assembly 68 is shown in FIG. 8. A side cutaway perspective view along arrows A—A of FIG. 8 is shown in FIG. 9. FIG. 10 shows a side cutaway view along arrows B—B of FIG. 8. Connector body 70 includes a base portion 96 and two wall segments 98. Base portion 96 is substantially cylindrical. Wall segments 98 are coupled to and extend upwardly from base portion 96 in the longitudinal direction. A pair of slide channels 100 are disposed between wall segments 98 and extend longitudinally. A pair of anti-rotation tab channels 102 also are disposed longitudinally and are about equally spaced from slide channels 100.

Figure 11:
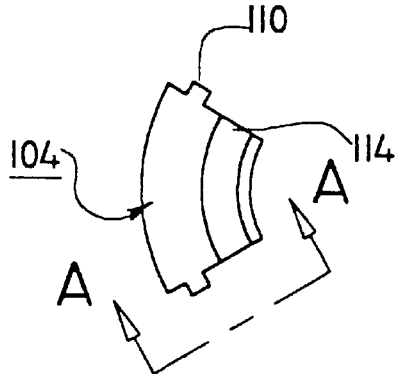
FIG. 11 shows a top view of the slide of the sliding locking end cap body shown in FIG. 7.
Figure 12:
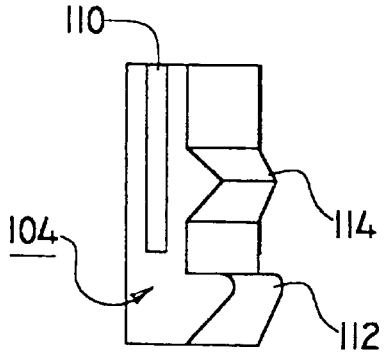
FIG. 12 shows a perspective view of the slide of the sliding locking end cap body shown in FIG. 11, viewed from the position and in the direction depicted by arrows A—A of FIG. 11.

Sliding locking end cap assembly 68 is adapted to receive and firmly engage a power source such as a GTO wire (GTO) using a slide assembly. Accordingly, each of wall segments 102 supports a slide 104 which effects the engagement of the power source. A top view of slide 104 is shown in FIG. 11, and a side perspective view is shown in FIG. 12. Each wall segment 102 includes a pair of parallel, annular wall portions 106 which form a slide assembly guide 108. A slide 104 is slidably disposed between each pair of slide assembly guides 108 so that it is movable in the longitudinal direction. Each slide 104 includes a guide flange 110 on opposing sides for sliding within slide assembly guide 108. Each slide 104 also includes a slide cam 112, and a slide locking embossment 114.

Connector 70 also includes a locking jaw assembly comprising a locking jaw for gripping the GTO wire, wherein the locking jaw comprises at least two gripping surfaces resiliently disposed within the interior wall cavity at the first cavity end by a pair of support members, at least one of the gripping surfaces being electrically conductive, and an electrically conductive contact ring electrically coupled to the at least one electrically conductive gripping surface, at least one of the support members being in slidable contact with the slide so that movement of the slide toward the first cavity end causes the support member to move at least one of the gripping surfaces closer to the GTO wire.

Figure 13:
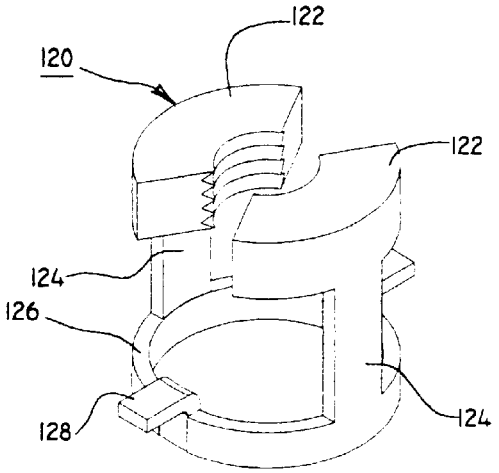
FIG. 13 shows a perspective view of the locking jaw assembly shown in FIG. 7.
Figure 14:
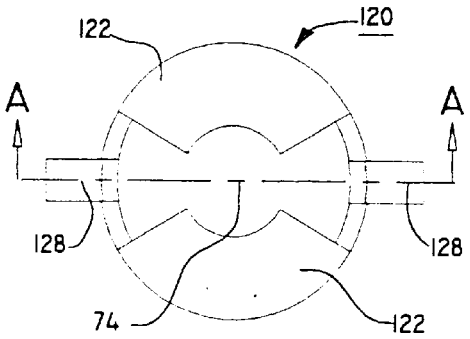
FIG. 14 shows a top view of the locking jaw assembly of FIG. 13.
Figure 15:
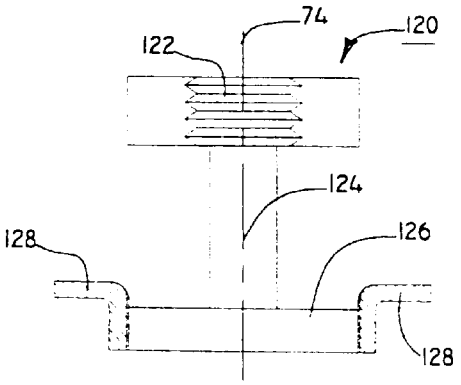
FIG. 15 shows a side cutaway view of the locking jaw assembly shown in FIGS. 13 and 14, viewed from the position and in the direction depicted by arrows A—A in FIG. 14.

In accordance with this embodiment, a locking jaw assembly 120 is disposed in interior cavity 86. A perspective view of locking jaw assembly 120 is shown in FIG. 13. A top view is shown in FIG. 14, and a side cutaway view is shown in FIG. 15. Locking jaw assembly 120 includes a pair of locking jaws 122 which are adapted to grip and engage the GTO wire. Locking jaws 122 comprise a GTO conductor contact ring constructed of a conductive material, such as a conductive metal, so that they come into electrical contact with the GTO wire when physically engaged by slides 104. Each locking jaw 122 is connected to a conductive post 124. Posts 124 in turn are physically and electrically coupled to an electrode mating contact ring 126 disposed at the proximal end of connector body 70. Posts 124 are biased outwardly so that locking jaws 122 normally are biased toward walls 98 of connector body 70 when slides 104 are located at their extreme outward positions, i.e., toward connector body wall 98. Contact ring 126 includes a pair of anti-rotation tabs 128 which are configured and sized to slide into anti-rotation tab channels 102 when locking jaw assembly 120 is slidably disposed within connector body 70, as shown in FIG. 7.

Connector 68 further includes sliding locking end cap top 72 (FIG. 16) coupled to connector body 70 at distal end 90 of interior cavity 86 at an abutting surface 130 to substantially enclose interior cavity end 90. Top 72 includes a GTO wire access 132 port for passage of the GTO wire through top 72. Port 132 includes an opening 134 for the insulated portion of the GTO wire, and an opening 136 for the GTO conductor. A compression relief slot 138 also is provided.

Figure 16:
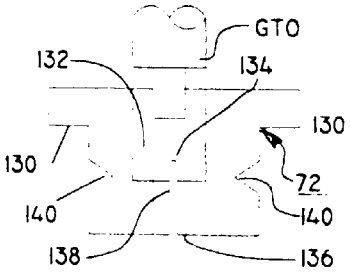
FIG. 16 shows a side cutaway view of the end cap top of the sliding locking end cap body shown in FIG. 7.

Sliding locking end cap top 72, a side cutaway view of which is shown in FIG. 16, is substantially cylindrical and is adapted to fit securely over connector body 70. End cap top 72 includes an end cap locking recess 140 for engaging slide locking embossment. Recess 140 is adapted to receive a snapping embossment 142 disposed within distal end 90 of cavity 86, and corresponding slide locking embossments 114.

In operation, end cap top 72 would be snapped onto and mechanically secured to connector body 70 as shown in FIG. 7., so that longitudinal axes 34 and 74 are substantially collinear. Locking end cap assembly 68 would be mechanically engaged to electrode housing assembly 30, whereby proximal end 76 of connector body 70 is mechanically coupled to distal end 38 of electrode housing 32. Slides 104 initially would be positioned at proximal end 76 of connector body 70 in the absence of a GTO wire, in which case locking jaws 122 would be positioned outwardly toward wall 98 under bias. To engage a GTO wire, the GTO wire would be inserted into GTO port 132 so that the conductor portion of the GTO wire is disposed within the area encompassed by locking jaws 122. Slides 104 then would be moved longitudinally toward distal end 78 of connector body 70, so that locking jaws 122 move against the bias inwardly under the force of slide cams 112 to engage the GTO wire.

Figure 17:
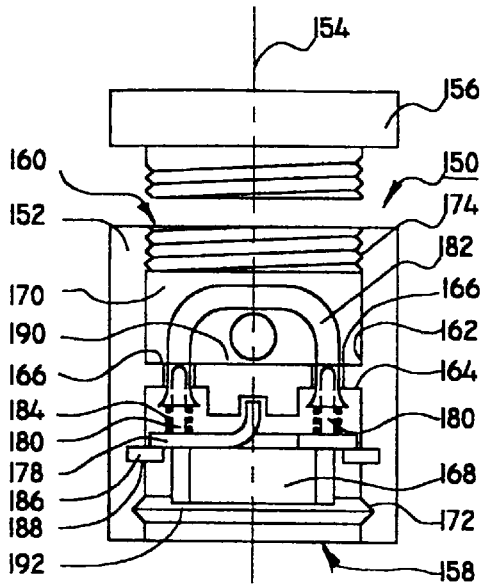
FIG. 17 shows a side cutaway view of a threaded locking end cap connector assembly for use in connecting a GTO wire to the electrode housing shown in FIG. 5 according to another preferred embodiment of the invention.
Figure 18:
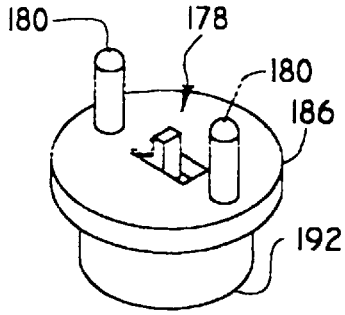
FIG. 18 shows a perspective view of the contact plate shown in the threaded locking end cap connector assembly of FIG. 17.
Figure 19:
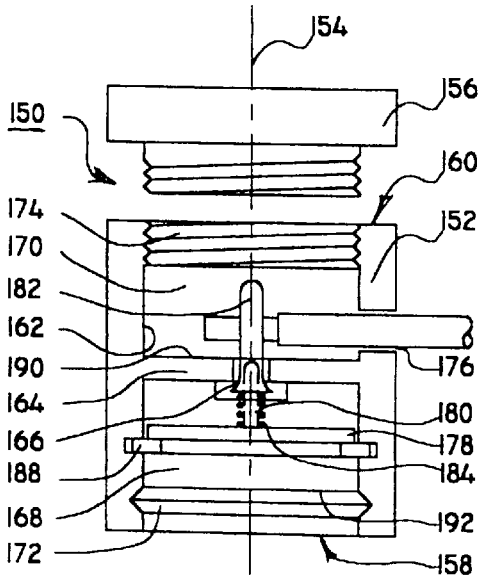
FIG. 19 shows another side cutaway view of the threaded locking end cap connector assembly shown in FIG. 17, but wherein the assembly has been rotated by 90° about its longitudinal axis relative to the view shown in FIG. 17.

A number of different approaches may be used for connecting the power source or GTO wire to the electrode housing. As an alternative to sliding locking end cap assembly 68 described above in connection with FIGS. 7–16, for example, a threaded locking end cap assembly 150 according to a preferred embodiment of the invention is shown in FIGS. 17–19. A cutaway side view is shown in FIG. 17. A cutaway side view similar to FIG. 17, but rotated by 90°, is shown in FIG. 19.

The connector according to this aspect of the invention comprises a connector body having a wall forming an interior cavity having a first end and a second end. First cavity end has threads. A GTO wire access port is provided for passage of the GTO wire through the wall.

In accordance with the preferred embodiment, threaded locking end cap assembly 150 comprises a substantially cylindrical connector body 152 disposed about a longitudinal axis 154, and a threaded locking end cap top 156. Connector body 152 has a proximal end 158 and a distal end 160. Connector body 152 also includes a substantially-cylindrical internal wall 162 parallel to longitudinal axis 154. Connector body also includes a surface 164 substantially perpendicular to wall 162 and longitudinal axis 154. Surface 164 includes two apertures 166. The surface of wall 162 at the proximal end of surface 164 forms a first interior cavity 168, and the surface of wall 162 at the distal end of surface 164 forms a second interior cavity 170. A bayonet-type locking recess 172 is provided at proximal end 158 of connector body 152 for sealably mating with embossment 64 of electrode housing 30 in a bayonet-type locking arrangement. Threads 174 are provided in connector body 152 at its distal end 160 for mating with threaded locking end cap top 156. A GTO wire access port 176 is provided for passage of a GTO wire through the cylindrical wall of connector body 152.

Connector 150 also includes a locking jaw assembly mounted within the interior wall cavity. The locking jaw assembly comprises a locking jaw movably and resiliently disposed over the first contact surface and biased away from the first contact surface so that the GTO wire may be inserted through the GTO wire access port and onto the first contact surface while the locking jaw is forced away from the GTO wire and the first contact surface.

The connector according to this aspect of the invention still further includes a cap having threads for mating to the connector body threads to detachably couple the cap to the connector body wall at the first cavity end to substantially enclose the first cavity end. The cap has a surface which moves toward and contacts the locking jaw and moves the locking jaw toward the first contact surface as the cap threads are further engaged, so that the further engagement of the cap threads causes the locking jaw to move against and secure the GTO wire on the first contact surface.

Referring to connector 150 as shown in FIG. 19, this threaded locking end cap assembly includes a locking jaw assembly which includes a contact plate 178 having a pair of posts 180 and a locking jaw 182 which is movably mounted on posts 180 in internal cavity 170. Springs 184 are disposed on posts 180 to bias locking jaw 182 upwardly in the distal direction. Contact plate 178 is held in position within internal cavity 168 by a retaining ring 186 which is disposed in a recess 188 within wall 162 in internal cavity 168.

Connector 150 includes a first contact surface 190 disposed within interior wall cavity 170 adjacent to GTO wire access port 176. GTO wire access port 176 is provided in wall 162 just above contact plate 178 in interior cavity 170. Threaded end cap top or cap top 156 is adapted to engage threads 174 at distal end 160 of connector body 150.

In operation, the GTO wire would be inserted into GTO wire access port 176 and into the open area created by the open-biased locking jaw 182. Embossment 64 of electrode housing 30 would be engaged with recess 172 so that connector 150 is mated to electrode housing 30 and their longitudinal axes 34 and 154 are substantially collinear. Cap top 156 then would be rotated to engage threads 174 and thereby tighten cap top 156 toward contact plate 178. As cap top 156 approaches contact plate 178, its proximate end will engage the top portion of locking jaw 182, which will force locking jaw 182 downward toward proximal end 158. This downward force will overcome the bias of springs 184 and force locking jaw 182 down onto the GTO wire, thereby facilitating the electrical contact with contact plate 178.

A lower edge 192 of contact plate 178 disposed toward proximal end 158 of connector body 152 would be in physical and electrical contact with contact ring 62 to electrically couple the GTO wire with electrode shell 54.

Another connector 200 according to the invention for use in a lighting device to connect an electrical power supply such as a GTO wire to a lighting electrode housing is illustrated in FIGS. 20 through 42. Connector 200 comprises a push button locking end cap assembly.

Figure 20:
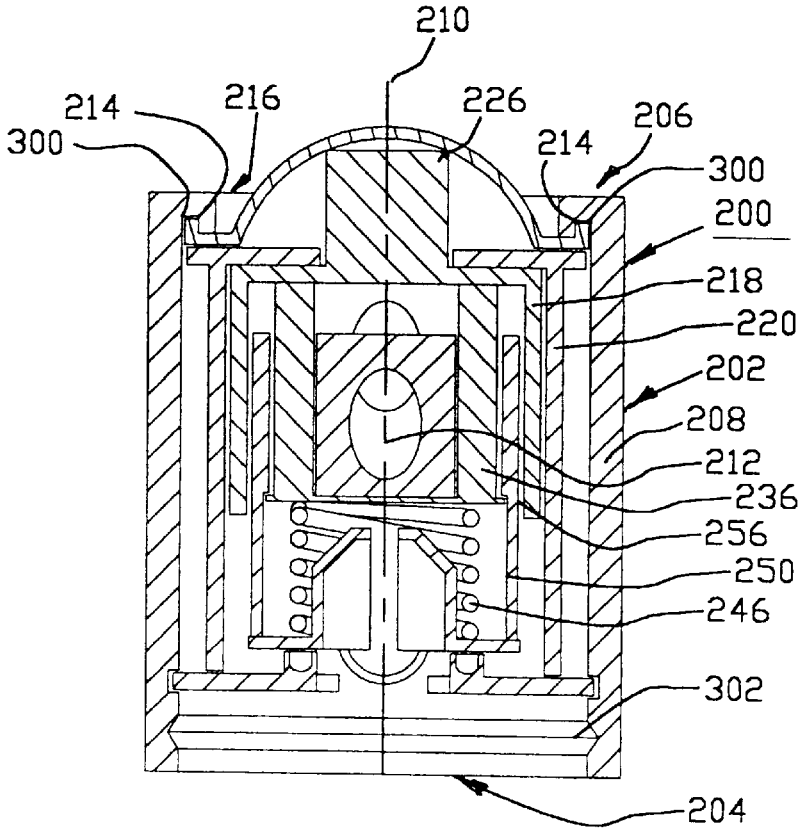
FIG. 20 shows a side cutaway view of a push button locking end cap according to another preferred embodiment of the invention for use in connecting a GTO wire to the electrode housing shown in FIG. 5.
Figure 21:
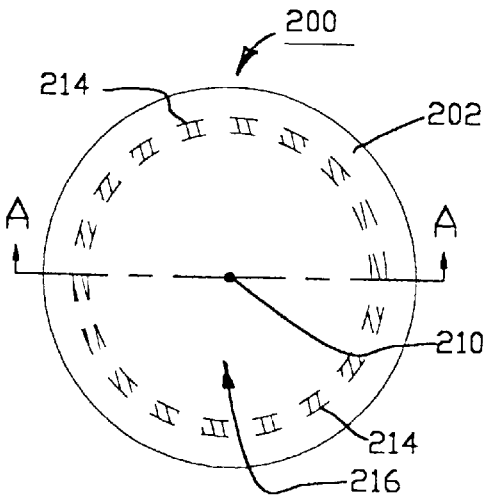
FIG. 21 shows a top view of an assembly housing for the push button locking end cap of FIG. 20.
Figure 22:
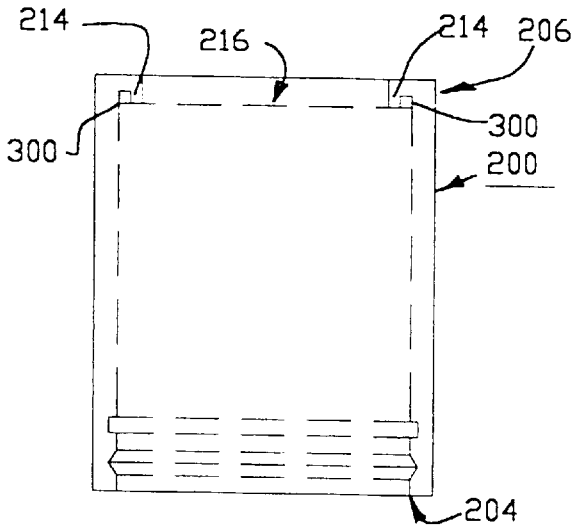
FIG. 22 shows a side cutaway view of the assembly housing shown in FIG. 21, viewed from the position and in the direction depicted by arrows A—A in FIG. 21.
Figure 23:
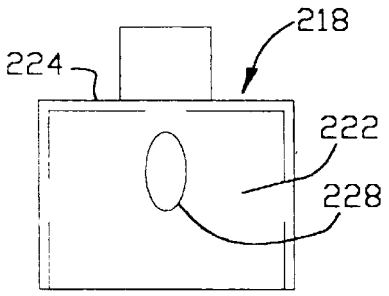
FIG. 23 shows a side view of a push button for the push button locking end cap shown in FIG. 20.
Figure 24:
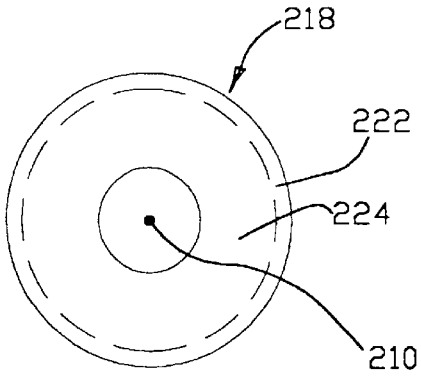
FIG. 24 shows a top view of the push button of FIG. 23.

With reference to FIG. 20, and as shown more specifically in FIGS. 21 and 22, connector 200 includes an assembly housing 202 having a first or proximal end 204 and a second or distal end 206. Assembly housing 202 includes a substantially cylindrical wall 208 disposed about a longitudinal axis 210. A first aperture 212 is provided for passage of the GTO wire through connector body wall 208. A flange 214 is disposed around an aperture 216 at distal end 206 of assembly housing 202.

A push button assembly is mounted within assembly housing 202. The push button assembly includes a push button member 218 disposed within a push button housing 220 so that push button member 218 can slide along longitudinal axis 210. A side cutaway view of push button member 218 according to the preferred embodiment is provided in FIG. 23, and a top view is provided in FIG. 24. Push button member 218 comprises a cylindrical wall 222 disposed about longitudinal axis 210 and a top surface 224 perpendicular to longitudinal axis 210. A cylindrical push button 226 extends upwardly from top surface 224 toward proximal end 204 of assembly housing 202. Cylindrical wall 222 includes an aperture 228 substantially equal in size to aperture 216. Push button member 218 is made of a non-conductive material, such as a rigid polymeric resin.

Figure 25:
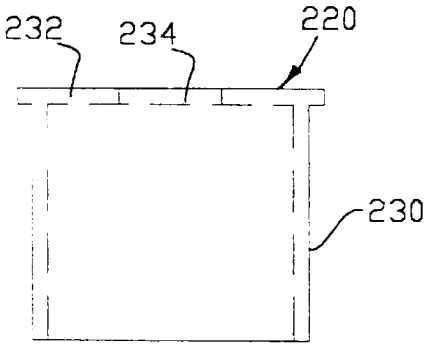
FIG. 25 shows a side view of a button housing for the push button locking end cap of FIG. 20.
Figure 26:
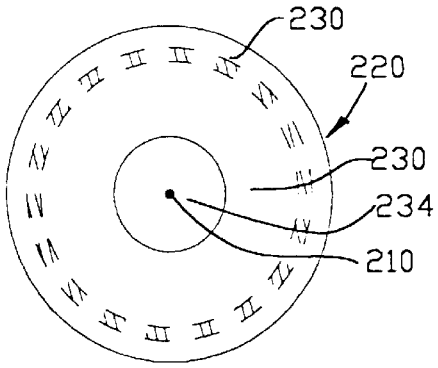
FIG. 26 shows a top view of the button housing of FIG. 25.
Figure 27:
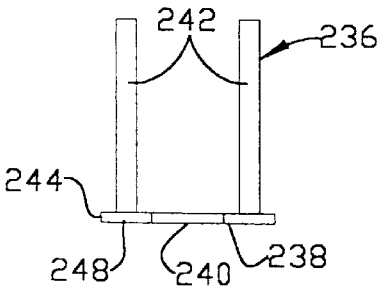
FIG. 27 shows a side view of the nylon stud ring and posts for the push button locking end cap of FIG. 20.
Figure 28:
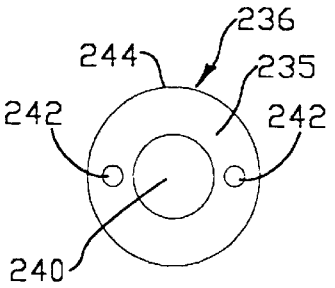
FIG. 28 shows a top view of the nylon stud ring and posts of FIG. 27.

A side cutaway view of push button housing 220 is provided in FIG. 25, and a top view is provided in FIG. 26. Push button housing 220 comprises a substantially cylindrical wall 230 disposed about longitudinal axis 210 and a top surface 232. The interior diameter of cylindrical wall 230 is slightly larger than the outside diameter of cylindrical wall 222 of push button member 218 (FIGS. 23 and 24) so that push button member 218 fits within the interior of push button housing wall 230 in sliding relationship. Top surface 232 includes an aperture 234 at its center which is slightly larger than the diameter of push button 226, so that button 226 can be inserted into aperture 234 and button 226 can slide longitudinally within aperture 234.

A nylon stud ring 236 is provided for helping to bias push button 226 in the distal direction along longitudinal axis 210. Stud ring 236 fits in the interior of cylindrical wall 222 of push button member 218. A side cutaway view of stud ring 236 is provided in FIG. 27, and a top view is provided in FIG. 28. Stud ring 236 includes a circular base 238 with an aperture 240. Two parallel posts 242 extend upwardly from base 238. The outer perimeter 244 of base 238 forms a lip extension.

A biasing means or biasing device is provided for biasing the second aperture out of alignment with respect to the first aperture, wherein the second aperture becomes aligned with the first aperture when a force is applied to the push button so that the GTO wire may pass through the first and second aperture, and wherein the biasing devices causes the first and second apertures to contact and grip the GTO wire when the force is removed. In this embodiment, the biasing means or device comprises a spring 246 disposed longitudinally which contacts the lower surface 248 of stud ring base 244. Spring 246 is adapted to bias stud ring 236 to contact lower surface 248.

Figure 29:
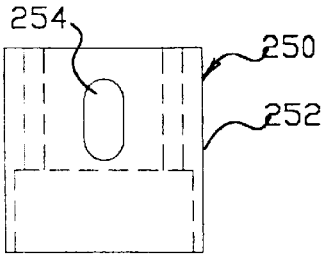
FIG. 29 shows a side view of a metal barrel for the push button locking end cap of FIG. 20.
Figure 30:
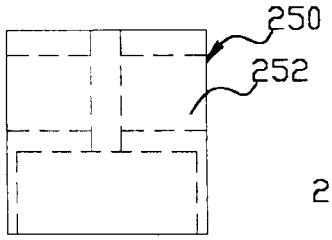
FIG. 30 shows another side view of the metal barrel of FIG. 29, but in which the metal barrel has been rotated by 90°.
Figure 31:
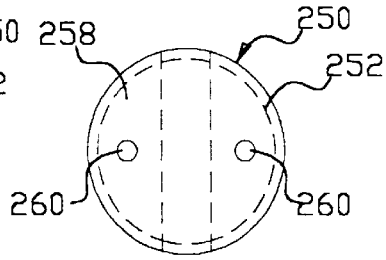
FIG. 31 shows a top view of the metal barrel shown in FIGS. 29 and 30.
Figure 32:
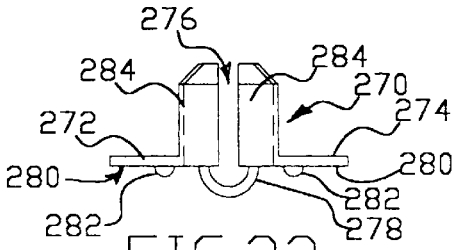
FIG. 32 shows a side view of a rocker pin lock for the push button locking end cap of FIG. 20.
Figure 33:
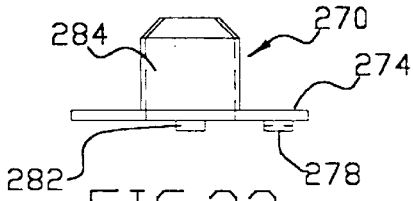
FIG. 33 shows a side view of the rocker pin lock shown in FIG. 32, but in which the rocker pin lock has been rotated by 90° about its longitudinal axis.
Figure 34:
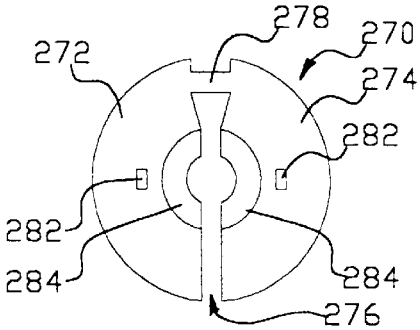
FIG. 34 shows a top view of the rocker pin lock of FIGS. 32 and 33.
Figure 35:
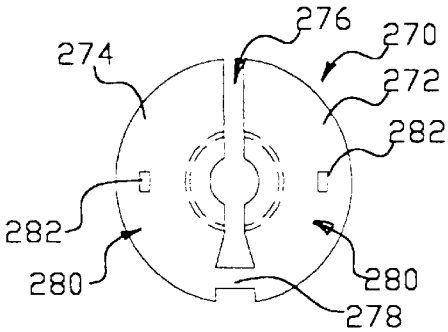
FIG. 35 shows a bottom view of the rocker pin lock of FIGS. 32 through 34.
Figure 36:
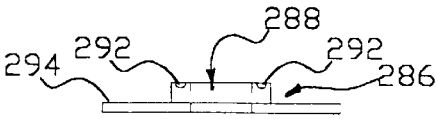
FIG. 36 shows a side view of a retainer ring for the push button locking end cap of FIG. 20.
Figure 37:
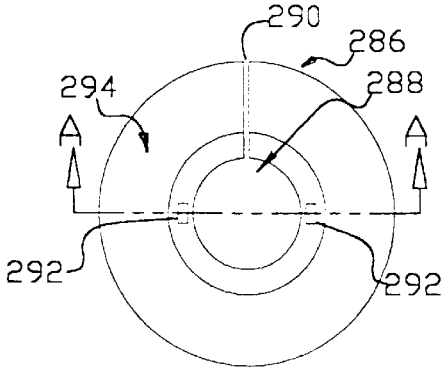
FIG. 37 shows a top view of the retainer ring shown in FIG. 36.
Figure 38:
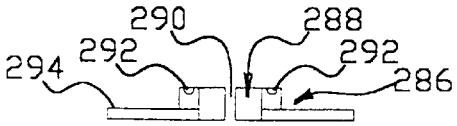
FIG. 38 shows a side cutaway view of the retainer ring of FIGS. 36 and 37, viewed from the position and in the direction depicted by arrows A—A in FIG. 37.

The push button assembly further includes a conductive barrel 250, as shown in detail in FIGS. 29-31. Barrel 250 has a cylindrical wall 252 disposed about longitudinal axis 210. An aperture 254 equivalent in size to push button member aperture 228 is provided in wall 252. wall 252 internally includes a shoulder 256 for contacting lip extension 244 of stud ring base 238. Barrel 250 includes a circular surface 258 having two holes 260 slightly larger than stud ring posts 242 to slidably receive these posts 242. Barrel surface 258 also includes a slot 262. Barrel 250 fits longitudinally inside push button member 218. The proximal end of spring 246 contacts the distal side of barrel surface 258.

The push button assembly also includes a conductive rocker pin lock 270, shown from various perspectives in FIGS. 32–35. Rocker pin lock 270 comprises two semi-circular metal pieces 272 and 274 separated by a slot 276 which extends along the diameter of the combined, generally circular rocker pin lock 270. A curved biasing tab 278 connects semi-circular pieces 272 and 274 near their outer perimeter. The curve of biasing tab 278 extends downwardly below the bottom surface 280 of pieces 272 and 274. A pair of rocker tabs 282 are provided on bottom surface 280 of the respective pieces 272 and 274 near the center of the combined circular rocker pin lock member 270. A pair of half-cylinder members 284 are provided on the upper surface of the respective pieces 272 and 274. Tabs 280 together have a generally cylindrical shape, albeit with the gap or space 276 in between them.

The push button assembly further includes a circular retainer ring 286 detachably disposed at proximal end 204 of assembly housing 202. Retainer ring 286, shown in FIGS. 36 through 38, includes an aperture 288 at its center, and a snap ring relief gap 290 extending radially from its center to its perimeter. A pair of fulcrum saddles 292 are provided on the upper surface 294 of retainer ring 286 near its center aperture 288 to receive rocker tabs 282 of rocker pin lock 270.

Figure 39:
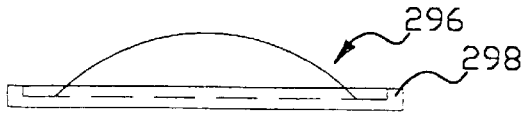
FIG. 39 shows a side view of the flexible button cover of the push button locking end cap in FIG. 20.
Figure 40:
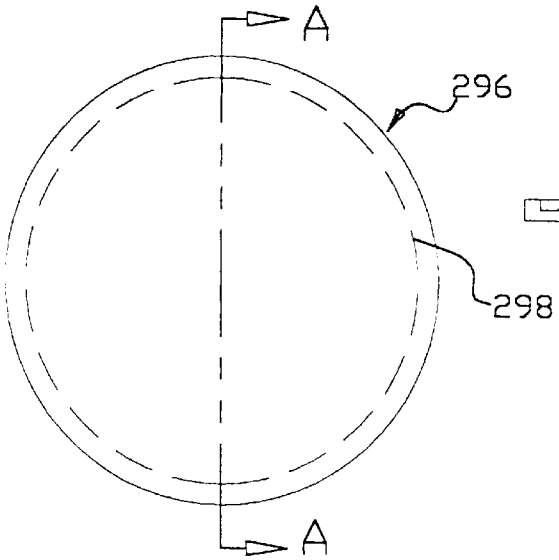
FIG. 40 shows a top view of the flexible button cover of FIG. 39.
Figure 41:
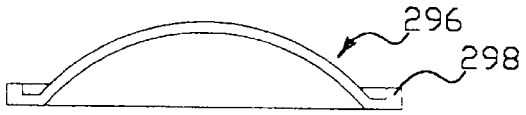
FIG. 41 shows a side cutaway view of the flexible button cover of FIGS. 39 and 40, viewed from the position and in the direction depicted by arrows A—A in FIG. 40.

A flexible button cover 296 is disposed in the distal end 206 of assembly housing 202 to cover push button 226. Button cover 296 of this embodiment, shown in FIGS. 39–41, is a crown-shaped rubber piece with an upwardly-extending flange 298 at its perimeter. This circular flange 298 mates with a recess 300 in the interior distal end of assembly housing 202 formed by flange 214 of the assembly housing, thereby providing a liquid-tight seal over push button 226.

Housing assembly 202 includes a fastener disposed at its proximal end for connecting the housing assembly to the electrode housing. In this embodiment the fastener comprises a recess 302 adapted to receive an embossment or lock tab such as embossment 64 of housing electrode 30 (FIG. 5) in a bayonet-type locking arrangement essentially as described above.

The push button assembly advantageously provides a dual-locking feature. It may be used in conjunction with an electrode housing such as that shown in FIGS. 5 and 6, for example, in the following manner. By depressing push button 226 through a first, relatively shallow range of movement, i.e., prior to the bottom edge of conductive barrel 250 contacting the lower side of surface 224 of push button member 218, apertures 216, 228 and 254 are aligned so that a GTO wire can be inserted through the apertures. When push button 226 then is released, the biasing means (spring 246) forces push button member 218 upwardly, thereby misaligning apertures 216, 218 and 254, narrowing the resulting combined aperture, and gripping the GTO wire. Rocker pin lock 270 is conductive, and it is electrically coupled to aperture 254 of barrel 250 and thus, in operation, to the GTO wire. When push button locking end cap 200 is coupled to electrode housing 30, contact ring 62 of electrode housing 30 contacts and is electrically coupled to the lower surface of rocker pin lock 270, thereby transferring the electrical energy from the GTO wire to electrode shell 54.

Figure 42:
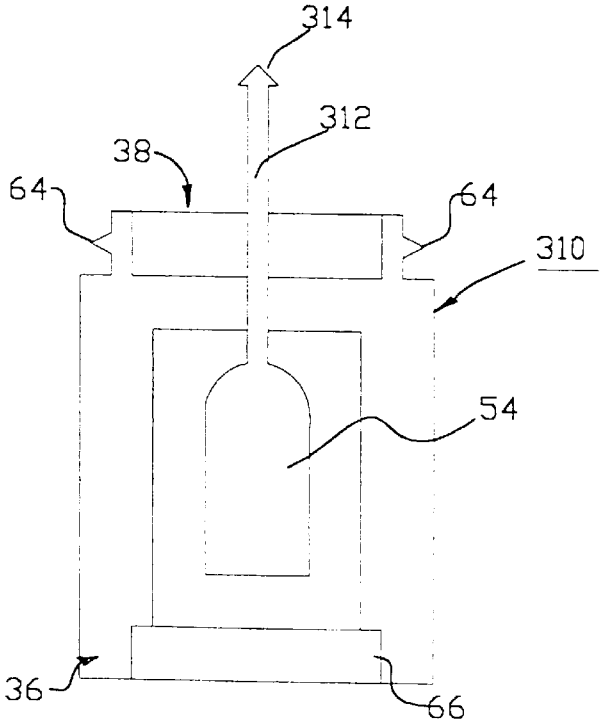
FIG. 42 shows a pin tail locking electrode housing according to another preferred embodiment of the invention.

The second locking feature of push button locking end cap assembly 200 may be employed, for example, with an electrode housing 310 as shown in FIG. 42. Depression of push button housing 220 beyond the point at which bottom edge of barrel 250 contacts the lower side of surface of push button member 218 causes force to be applied at the outer periphery of rocker pin lock 270. This opens gap 276 between half-cylinder members 284 of rocker pin lock 270. A contact pin 312 of electrode housing 310 then is inserted into this gap 276. Release of push button 226 then causes members 284 to approach one another under the force of spring 246. This tightens members 284 onto contact pin 312 and grips contact pin 312. A barb 314 at the end of contact pin 312 helps to prevent unwanted withdrawal of contact pin 312. Contact pin 312 is in electrical communication with electrode shell 54, so that this configuration electrically couples the GTO wire to the electrode shell.

To enhance the performance and extend the lifetime of the lighting device, it may be desirable to provide a coating, which preferably would be disposed on the interior wall surface of wall 12 or tube 14. The coating would be added, for example, to decrease diffusivity and permeability of gases into or out of the envelope. In the case of lighting devices which use phosphors, wherein interior surface coatings are used as part of the lighting device design to enhance illumination, such coatings may reside between the envelope wall and the phosphor coating, and/or between the phosphor coating and the contained gas. Incidentally, it will be recognized by those of ordinary skill in the art that a wall coating may not be necessary or even appropriate in all circumstances.

The particular coating used in a given instance will depend upon a number of factors, including the specific compositions of the wall material, the gases contained within the envelope, the operating temperature and pressure, etc. Preferably the thickness and continuity are sufficient to inhibit outgassing from and/or diffusion through the wall. Specific coating materials preferably include organic and/or silicon-bearing (e.g., silica) polymers or extended networks. Thin films with combined organic and inorganic functionalities would be examples.

In accordance with one aspect of the invention, a coating is provided for a polymeric wall of a lighting device, wherein the coating comprises silica. The silica coating may be disposed on the interior or exterior surface of the wall, but preferably is disposed on the interior surface.

A preferred coating material was prepared in the following manner for the lighting device shown in FIG. 1. This coating and method are merely illustrative, but provide a good example of coatings and techniques which may be used advantageously according to the principles of the invention.

This coating was prepared for disposition on the interior wall of lighting device 10, which wall of course comprises part of envelope E. The method employed includes causing the pressure within the envelope to be substantially at a vacuum, and desorbing unwanted gases from the wall. In carrying out this step, envelope E and therefore interior surface of wall was exposed to dynamic vacuum (i.e., about $2\times10^{-5}$ torr) by means of an $LN_2$-trapped, diffusion-pumped vacuum manifold. Envelope E then was headed internally by oxygen ($O_2$) plasma bombardment several times for several minutes each cycle. Each cycle dissipated about 200 watts. This step was carried out to desorb and outgas as much moisture and other unwanted gases and vapors as possible from interior surfaces of wall 12.

A deposition gas then was prepared as follows. A gaseous mixture was formed comprising a siloxane and a carrier gas. The preferred siloxane is a disiloxane or an organodisiloxane and, more preferably, 1,1,3,3-tetramethyldisiloxane (CA Registry No. 3277-26-7, formula $H(CH_3)_2SiOSi(CH_3)_2H$, hereinafter "TMDS"). The preferred carrier gas is oxygen gas. The TMDS preferably should be present with the oxygen gas at a ration of at least about 1 to 10, respectively, and more preferably the ratio would be about 1 to 10, respectively. This TMDS-oxygen gas mixture, or "deposition gas" preferably consists of or consists essentially of TMDS and oxygen.

The TMDS and oxygen gas were pre-mixed in a separate region of the vacuum manifold to form the deposition gas. According to the method, at least one of electrical and electromagnetic energy is applied across the envelope to cause a portion of the deposition gas to deposit on the wall as a silica coating. As carried out in the exemplary method, a 9-kilovolt, 60 Hz source was applied across envelope E via electrodes 28*a* and 28*b*. The deposition gas was then flowed into envelope E so that the pressure within envelope E was about 2 torr (preferably it should be no greater than about 2 torr), at which stage the decomposition/reaction with oxygen gas was indicated by a visible turbulence in the plasma which subsided momentarily, indicating that the reaction was complete.

At this stage the high voltage was terminated, and the decomposition products were evacuated. The newly-formed silica layer was conditioned with $O_2$ plasma as described above to complete the oxidation of the newly-formed silica layer.

This procedure of silica deposition and oxygen plasma conditioning was repeated several times (cycled) to build up a thick layer of silica. In this application of the method, approximately 5 cycles were carried out to achieve an estimated silica layer thickness of microns or tens of microns. Preferably the deposition is carried out until the barrier layer adequately inhibits outgassing and diffusion. In our experiments we continued the deposition until the silica layer became faintly visible.

Upon completing the cycling, the evacuated envelope E was again subject to high voltage across electrodes 28*a* and 28*b*, and then filled with neon so that a bright plasma was sustained (i.e., at about 2 torr), and envelope E then was sealed.

The lighting device using this silica-coated wall structure operates at a temperature significantly lower than an untreated tube. This is believed to be because outgassing during operation has been reduced. This method differs from conventional techniques in that, for example, in conventional methods the specimen is placed in the treatment chamber, whereas in this new process the specimen to be treated is itself the treatment volume or chamber.

Turning now to the method according to invention for making a lighting device, the method includes the steps of providing an optically non-opaque wall consisting essentially of a polymeric material to define a portion of a sealed envelope; disposing and sealing a gas within the envelope at a pressure of less than one atmosphere absolute; and attaching an electrical driving means in at least one of electrical and electromagnetic communication with the gas for activating the gas to generate light.

The specific manner in which this method is carried out will depend upon the type of lighting device to be made, its specific size, shape, materials, etc. To illustrate the method of the invention, a preferred method will now be described which is particularly adapted for making lighting device 10 as shown in the drawing figures and described above.

The first step of the preferred method involves providing an optically non-opaque wall consisting essentially of a polymeric material to define a portion of a sealed envelope. This step preferably includes providing the polymeric material in the form of a polycarbonate material.

The wall may be made according to a number of techniques. Because the wall comprises a polymeric material, a variety of generally known polymer-forming techniques may used, but adapted of course for making the types of wall shapes and sizes applicable here. Polymer fabrication methods and processes such as extrusion, molding, injection molding, blow molding, vacuum molding, etc. may be used.

If the wall is to comprise a plurality of sections and connectors, it is necessary to join these components together. This may be done using the joining techniques, such as those disclosed above, which satisfy the requirements of vacuum retention and low gas permeability, durability, optical quality, etc., as noted above.

As an optional and preferred step, the method according to the invention includes providing a coating, preferably a silica coating, on at least one of the surfaces of wall. This step preferably would be carried out as described above for depositing the silica layer on the interior surface of wall 12 using the method as described above.

The preferred method also includes a step of attaching an electrical driving means in at least one of electrical and electromagnetic communication with the gas for activating the gas to generate light.

Figure 43:
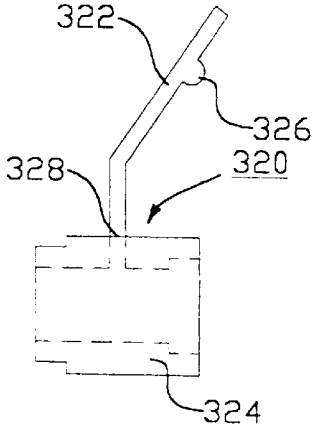
FIGS. 43 and 44 show a tabular coupling used in the preferred method for evacuating the envelope and charging it with gases.
Figure 44:
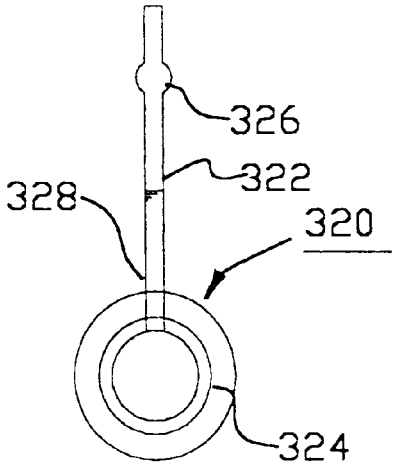

Preferably as final step in the preferred method, a gas is disposed and sealed within the envelope at a pressure of less than one atmosphere absolute. One aspect of this step involves selecting the particular gas and its composition. As noted above, the discharge gas will depend upon the specific application, but preferably will comprise a mixture of one or more noble gases and an additive such as mercury vapor. The discharge gas may be injected into envelope E in any one of a number of ways well known in the gas discharge lighting art. For example, with reference to FIGS. 43 and 44, evacuation, recharging and mercury addition is facilitated by a tubulated coupling 320. Coupling 320 would be attached, for example, between electrode housing 30 and a connector such as those described herein. An access or filler tube 322 extends from a main body 324 of coupling 320, and a reservoir 326 is provided within filler tube 322. In operation, a material such as mercury may be placed in reservoir 326, and the system sealed. Gases then may be passed through filler tube 322 to evacuate and/or fill envelope E. Filler tube 322 then may be physically tilted so that gravity no longer holds the mercury in reservoir 326, and causes it to flow down tube 322 and into envelope E. At the appropriate stage, filler tube 322 may be sealed at location 328, for example, by melting that portion of tube 322, to seal envelope E.

In accordance with another aspect of the invention, a lighting device, preferably an incandescent lighting device, is provided which comprises an optically non-opaque wall consisting essentially of a polymeric material and defining a portion of an envelope; a light source sealed within the envelope at a pressure of less than one atmosphere absolute; and an electrical driving means in electrical communication with the light source for causing the light source to generate light. The polymeric wall material preferably comprises a polycarbonate material, and more preferably consists of or consists essentially of a polycarbonate material.

Figure 45:
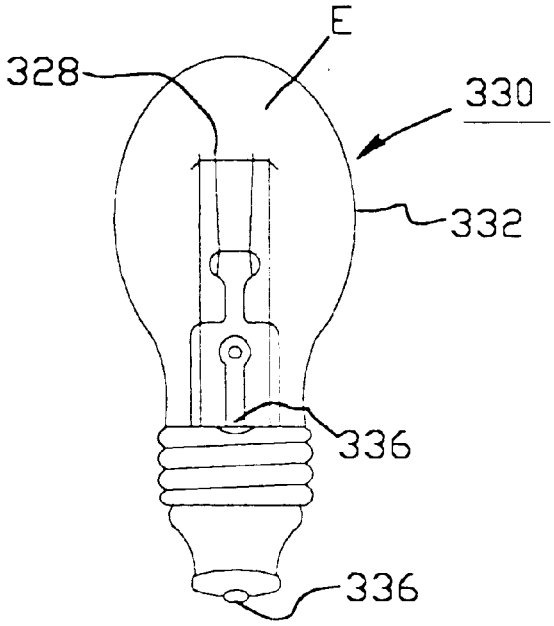

A lighting device 330 according to a preferred embodiment of this aspect of the invention is shown in FIG. 45. Lighting device 330 is an incandescent light bulb. Device 330 includes an optically non-opaque wall or bulb 332 consisting essentially of a polymeric material and defining a portion of an envelope E. Device 330 also includes a light source in the form of a filament 334 sealed within envelope E at a pressure of less than one atmosphere absolute. An electrical driving means in the form of a 110-volt, 60-Hz AC electrical power source 336 (e.g., a wall plug outlet or cord, not shown, but represented in FIG. 45 by the positive and negative contacts) is in electrical communication with filament 334. Application of electrical power from power source 336 causes filament 334 to generate light, in substantially known manner. The polymeric wall material consists essentially of a polycarbonate material such as those identified and in the referenced patents.

Additional advantages and modifications will readily occur to those skilled in the art. Therefore, the invention in its broader aspects is not limited to the specific details, representative devices, and illustrative examples shown and described. Accordingly, departures may be made from such details without departing from the spirit or scope of the general inventive concept as defined by the appended claims and their equivalents.

What is claimed is:

1. A lighting device, comprising:

an optically non-opaque wall consisting essentially of a polymeric material and defining a portion of an envelope;

a light source sealed within the envelope at an operating pressure of less than one atmosphere absolute, the envelope maintaining the light source at the operating pressure; and an electrical driving means in electrical communication with the light source for causing the light source to generate light.

2. A lighting device as recited in claim 1, wherein the lighting device is an incandescent lighting device.

3. A lighting device as recited in claim 1, wherein the polymeric wall material comprises a polycarbonate material.

4. A lighting device as recited in claim 1, wherein the polymeric wall material consists essentially of a polycarbonate material.

5. A lighting device, comprising:

an optically non-opaque wall consisting essentially of a polymeric material and defining a portion of an envelope;

a gas disposed and sealed within the envelope at a pressure of less than one atmosphere absolute, the wall being substantially impermeable by the gas; and an electrical driving means in at least one of electrical and electromagnetic communication with the gas for activating the gas to generate light.

6. A lighting device as recited in claim 5, wherein the lighting device is a gas discharge lighting device.

7. A lighting device as recited in claim 5, wherein the polymeric wall material comprises a polycarbonate material.

8. A lighting device as recited in claim 5, wherein the polymeric wall material consists essentially of a polycarbonate material.

9. A lighting device as recited in claim 5, wherein the wall comprises a substantially cylindrical tube.

10. A lighting device as recited in claim 5, wherein the wall comprises a substantially spherical shape.

11. A lighting device as recited in claim 5, wherein the wall has a cross sectional shape that is non-circular and non-elliptical.

12. A lighting device as recited in claim 5, wherein the wall has a cross sectional profile that is substantially discontinuous.

13. A lighting device as recited in claim 5, wherein the wall comprises a plurality of wall sections and at least one coupler for sealably mating at least two adjacent ones of the wall sections to one another.

14. A lighting device as recited in claim 13, wherein the coupler includes a slip joint.

15. A lighting device as recited in claim 13, further including a bonding agent for bonding the at least two adjacent wall sections to the at least one coupler.

16. A lighting device as recited in claim 5, wherein the wall includes a colorant dispersed within the polymeric material.

17. A lighting device as recited in claim 5, wherein the gas comprises mercury vapor.

18. A lighting device as recited in claim 5, wherein the gas comprises at least one noble gas.

19. A lighting device as recited in claim 5, wherein the pressure within the envelope is at most about 20 torr.

20. A lighting device as recited in claim 5, wherein the gas has an operating temperature in the envelope of between about 32° C. and 230° C.

21. A lighting device, comprising:

an optically non-opaque wall consisting essentially of a polymeric material and defining a portion of an envelope;

a coating comprising a silicon-bearing material disposed on the wall;

a gas disposed and sealed within the envelope at a pressure of less than one atmosphere absolute, the wall being substantially impermeable by the gas; and an electrical driving means in at least one of electrical and electromagnetic communication with the gas for activating the gas to generate light.

22. A lighting device as recited in claim 1, wherein:

the wall includes an interior surface and an exterior surface; and the coating is disposed upon the interior wall surface.

23. A lighting device as recited in claim 1, wherein the coating comprises silica.

* * * * *